US006622509B2

(12) United States Patent
Stich et al.

(10) Patent No.: US 6,622,509 B2
(45) Date of Patent: Sep. 23, 2003

(54) INTEGRAL WATER FILTER AND TANK

(75) Inventors: Richard Anthony Stich, Saluda, NC (US); Jimmy Nelson Knight, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/683,366

(22) Filed: Dec. 19, 2001

(65) Prior Publication Data

US 2003/0110791 A1 Jun. 19, 2003

(51) Int. Cl.[7] ..... F25D 3/02
(52) U.S. Cl. ..... 62/318

(58) Field of Search ..... 62/318, 337, 338, 62/339, 440, 441

(56) References Cited

U.S. PATENT DOCUMENTS 3,511,415 A * 5/1970 Crowe ..... 222/146
3,982,406 A * 9/1976 Hanson et al. ..... 62/339
5,112,477 A * 5/1992 Hamlin ..... 210/85

* cited by examiner

*Primary Examiner*—Denise L. Esquivel
*Assistant Examiner*—Malik N. Drake
(74) *Attorney, Agent, or Firm*—H. Neil Houser; Armstrong Teasdale, LLP

(57) ABSTRACT

A chilled water supply system for a refrigerator is provided. The system includes a water storage tank comprising an outlet leg, and a filter media disposed within said outlet leg.

24 Claims, 2 Drawing Sheets

INTEGRAL WATER FILTER AND TANK

BACKGROUND OF INVENTION

This invention relates to water dispensing systems for refrigerators, and, more particularly, to filtered water dispensing systems for refrigerators.

Refrigerators typically include water storage tanks for cooling and storage of water to be dispensed. In one type of dispensing system, a serpentine water storage tank is employed with a water filter. See, for example, U.S. Pat. No. 3,511,415. Further, some dispensing systems include a water filter adjacent to a water storage tank located in a fresh food compartment of the refrigerator.

A filter adjacent to a water storage tank in thermal communication with a fresh food compartment of a refrigerator requires a first plumbing joint connecting the tank and filter and a second plumbing joint connecting the filter to an outlet line. Over time, these joints are susceptible to unpleasant-and undesirable leakage. Also, adding a filter to the water dispensing system requires extra space that could otherwise be used for refrigerator compartment space, and increases material costs and assembly costs of dispensing system production.

SUMMARY OF INVENTION

In one aspect, a chilled water supply system for a refrigerator is provided. The system comprises a water storage tank comprising an outlet leg, and a filter media disposed within said outlet leg.

In another aspect, a water dispensing system for a refrigerator is provided. The system comprising a water storage tank comprising at least an inlet portion for storage of unfiltered water and an outlet portion comprising a filter media for filtering said unfiltered water before use.

In an additional aspect, a refrigerator is provided. The refrigerator comprises a fresh food compartment and a water dispensing system in thermal communication with said fresh food compartment,. The water dispensing system comprises a water storage tank comprising at least an inlet portion for storage of unfiltered water and an outlet portion for discharging filtered water. A perforated tube is disposed within said outlet portion and comprises an upstream end and a downstream end, a base extending from said upstream end and an end cap extending coupled to said downstream end. A filter media disposed about said tube between said end cap and said base.

In still another aspect, a method of supplying chilled filtered water from water dispensing system including an integral water tank and filter assembly having an inlet line and an outlet line is provided. The method comprises the steps of introducing warm water into the tank through the inlet line, passing the introduced water through the tank to chill the water, filtering the chilled water while the water is within the tank, and discharging the chilled water to the outlet line.

In a further aspect, a method of supplying chilled filtered water with a refrigerator dispensing system is provided for a refrigerator including a fresh food compartment and the dispensing system including an integral water tank and filter assembly, the tank having an inlet, an outlet, and a flow path therebetween. The method comprises the steps of fastening the tank in a substantially horizontal position in thermal communication with the fresh food compartment, connecting the tank inlet to a water supply inlet line such that relatively warm water is introduced into the tank through the inlet line, connecting the tank outlet to a dispenser system outlet line, passing the introduced water through the flow path to chill the introduced water, filtering the chilled water while the water is within the tank just prior to use; and discharging the chilled water to the outlet line.

In still a further aspect, a method of supplying chilled filtered water with a refrigerator dispensing system is provided, the refrigerator including a fresh food compartment and the dispensing system including an integral water tank and filter media disposed about a tube within the tank, the tube having a downstream end, the tank having an inlet and a serpentine flow path therebetween. The method comprising the steps of removably fastening the tank in a substantially horizontal position in thermal communication with the fresh food compartment, connecting the tank inlet to a water supply inlet line such that relatively warm water is introduced into the tank through the inlet line, connecting the downstream end of the tube to a dispenser system outlet line, passing the introduced water through the flow path to chill the introduced water, passing the introduced water radially through the filter media and into the central tube just before use, and discharging the chilled water from the tube downstream end to the dispenser system outlet line.

In still an additional aspect, a replacement kit for a water storage tank and water filter of a chilled water supply system for a refrigerator including a fresh food compartment floor is provided. The replacement kit includes an integral serpentine water storage tank and water filter media, said water filter media within an outlet leg of said tank, and a quick release fastener configured to rapidly attach said unit to the fresh food compartment floor.

DETAILED DESCRIPTION

Figure 1:
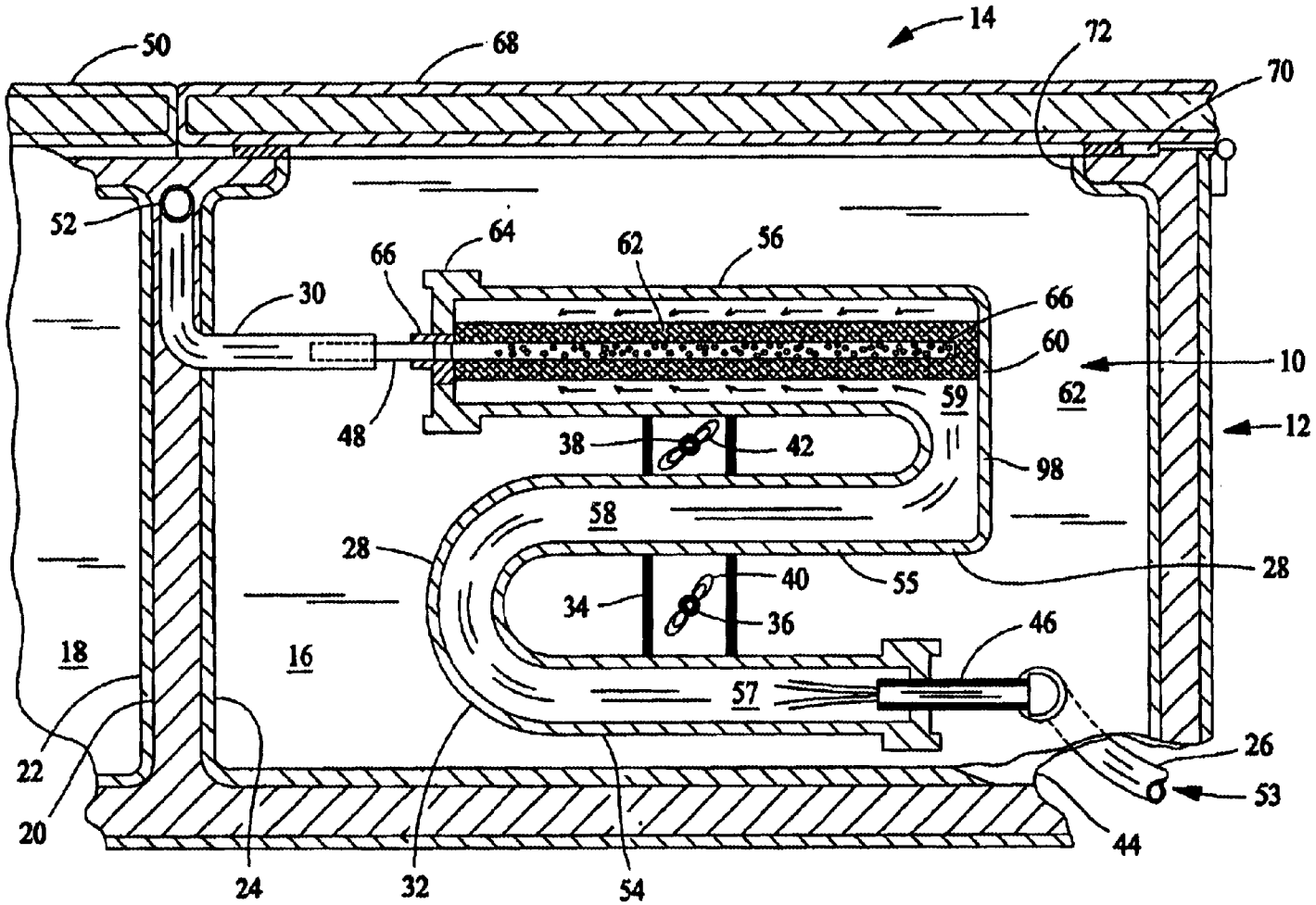
FIG. 1 is a partially broken-away top cross-sectional view through an integral water tank and filter.

FIG. 1 is a top cross sectional view of an exemplary water dispensing system 10 located in an exemplary lower portion 12 of an exemplary refrigerator 14. Refrigerator 14 includes a fresh food compartment 16 and a freezer compartment 18. Compartments 16 and 18 are separated by an insulation barrier 20 and two plastic coating layers 22 and 24. System 10 is located in thermal communication with compartment 16, and, in one embodiment is positioned in fresh food compartment 16 adjacent a floor thereof. It is recognized, however, that the benefits of the present invention accrue to many types of refrigerators beyond exemplary refrigerator 14, and further that the benefits may be realized by positioning water dispensing system 10 elsewhere in a refrigerator than, for example, lower portion 12.

System 10 includes an inlet line 26, a water tank 28, and an outlet line 30. Water tank 28 is fabricated from known methods, such as blow molding, and is serpentine shaped, i.e. curves back and forth, to increase a length of its flow path between an inlet line 26 and outlet line 30 while conserving space. Serpentine water tank 28 is shaped like an inverted "S", although other serpentine shapes could be used having any desired number of bends 32. Serpentine water tank 28 is attached to a rectangular bar 34 with two openings 36 and 38. Lower portion 12 has two vertical studs (not shown) which pass through openings 36 and 38. Wing nuts 40 and 42 are attached to the vertical studs to hold bar 34 to a floor 44 of refrigerator lower portion 12. Inlet line 26 passes through floor 44 and into compartment 16 where it is connected to an inlet 46 of tank 28. Outlet line 30 is connected to an outlet 48 of tank 28 and then passes through barrier 20 and a freezer door 50 to a water dispenser (not shown) by way of a vertical portion 52 of outlet line 30. System 10 receives water entering system 10 through inlet line 26 as shown by arrow 53. Unfiltered water is cooled during its passage through serpentine tank 28 and ultimately filtered and discharged as cooled water through outlet line 30 to a water dispenser (not shown.) just prior to use.

Serpentine tank 28 includes a longitudinally extending inlet leg 54, a longitudinally extending center leg 55 and a longitudinally extending outlet leg 56. Inlet leg 54 receives warm water 57, which passes through leg 54 for a sufficient time to allow heat to escape from warm water 57 to produce slightly cooled water 58. Slightly cooled water 58 exits inlet leg 54 and enters center leg 55. Additional heat escapes from slightly cooled water 58 during its passage through center leg 55 to produce cooled water 59. Cooled water 59 exits center leg 55 and enters outlet leg 56. During its passage through outlet leg 56, further heat escapes from cooled water 59 before passing through a cylindrical filter media 60 and a collection center tube 62 into outlet tube 48. Filter media 60 is fabricated from known materials and is held within outlet leg 56 by an outlet cover such as end cap 64 or other known cover members. End cap 64 includes a boss 66 that holds center tube 62 within filter media 60.

While the illustrated embodiment includes a substantially parallel inlet leg 54, center leg 55, and outlet leg 56, it is recognized that the legs of the water tanks need not be parallel in alternative embodiments to achieve at least some of the benefits of the present invention. Additionally, it is appreciated that the benefits of the invention may be obtained in alternative embodiments with U-shaped water tanks, or other non-serpentine shaped water tanks apparent to those in the art.

Filter media 60 is spaced radially inward from outlet leg 56, and collection center tube 62 includes a plurality of perforations or inlet openings 66 to facilitate uniform flow of water through media 60 and into center tube 62. This configuration allows use of larger surface area filters, providing smaller pressure drops during flow than known comparable compact removable filter elements. Consequently, cooled, filtered water flows from center tube 64 to outlet tube 48, where outlet tube 48 delivers cooled, filtered water to outlet line 30. From outlet line 30, water is dispensed by a dispensing system (not shown) upon user demand. Fresh food compartment door 68 forms a seal 70 with a door opening 72, to keep compartment 16 cool by normal operation of refrigerator 14, which, in turn, cools water in system 10. In one embodiment, the dispenser mechanism also dispenses crushed ice and cubed ice, and is located on a front of freezer door 50 to provide a relatively direct path for ice. In alternative embodiments, the dispenser mechanism is located elsewhere on refrigerator 14.

Water tank 28 with integral filter media 60 may be easily removed by disconnecting wing nuts 40 and 42 from bar 34 to release tank 28. The entire tank 28, together with filter media 60, is disconnected from inlet line 26 and outlet line 30 and removed through door opening 72. Another tank 28 and integral filter media 60 is replaced by reconnecting inlet line 26 and outlet line 30 and fastening wing nuts 40 and 42 to bar 34. Thus, a reliable water filter assembly is provided within the water storage tank to conserve space of the refrigerator fresh food compartment, and simple hand installation and removal without tools reduces assembly costs and maintenance difficulties.

Figure 2:
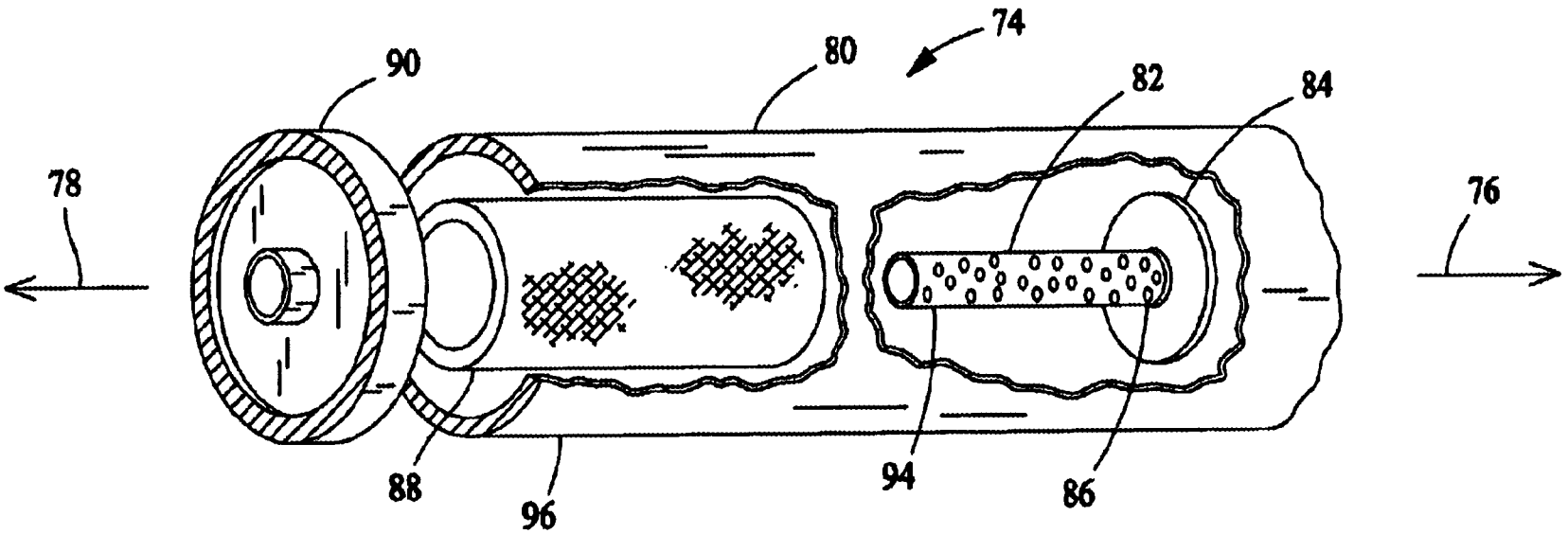
FIG. 2 is an exploded top view, in partial cutaway, of a second exemplary embodiment of an integral water tank and filter.

FIG. 2 is an exploded top view, in partial cutaway, of outlet leg 56. An upstream direction is shown by arrow 76 and a downstream direction by arrow 78. Center tube 62 includes an annular base 84 attached to a center tube upstream end 86 that restrains filter media 60 against movement upstream. Cylindrical filter media 60 includes a central opening therethrough to receive center tube 62. End cap 90 is ultrasonically welded to boss 66 on a downstream end 94 of tube 82 to capture filter media 60 between base 84 and cap 90. Filter media 60 is a thick cylindrical tube configured to fit within outlet leg 56. Filtering of water in outlet leg 56 allows storage of water in tank 28 (shown in FIG. 1) in an unfiltered condition until just before use. Thus, bacterial suppressing chlorine treatments frequently employed in municipal water treatment systems are not filtered from the water in the tank until just before use, thereby minimizing bacterial re-growth in water tank 28 that may otherwise occur if water was filtered within water tank inlet leg 54 or center leg 56 (shown in FIG. 1).

In alternate embodiments, outlet leg 56 and filter media 60 vary in length. Further alternate embodiments include varying numbers of water tank legs, subject to limitations of the size of compartment housing. Other leg configurations of inlet leg 54 (shown in FIG. 1) and center leg 55 (shown in FIG. 1) may be employed in various alternative embodiments within the scope of the present invention. End cap 90 is ultrasonically welded to a downstream end 96 of leg 56 to form a permanently sealed water dispensing system 10. System 74 is removably attached with wing nuts (not shown) as described above in relation to FIG. 1. While in the described embodiment, the storage tank and filter media are a disposable unit, it is contemplated that a removable end cap may be provided such that the filter media may be replaced and the water tank be reused in an alternative embodiment within the scope of the invention.

In a further embodiment, the above-described integral filter/tank of dispenser system 10 is positioned horizontally or slightly inclined to facilitate escape of air in the tank when the tank is initially filled, as well as facilitating uniform passage of cooling air around the serpentine tank. Horizontal placement of the tank also permits the tank to be placed adjacent a floor of a fresh food compartment of the refrigerator where freezing of water in the tank is least likely.

A disposable and easily replaced integral tank and filter is therefore provided that eliminates plumbing joint connections to and from conventional water filters located adjacent, or outside, conventional storage tanks. Replacement of the water tank at the time the filter replacement reduces likelihood of late-in-life water tank leaks.

While the invention has been described in terms of various specific embodiments, those skilled in the art will recognize that the invention can be practiced with modification within the spirit and scope of the claims.

What is claimed is:

1. A chilled water supply system for a refrigerator, said system comprising:

a water storage tank comprising an outlet leg; and a filter media disposed within said outlet leg.

2. A system in accordance with claim 1 wherein said water storage tank has a serpentine shape.

3. A system in accordance with claim 1 wherein said filter media is permanently disposed within said outlet leg.

4. A system in accordance with claim 1 wherein the refrigerator includes a fresh food compartment, said tank configured to be positioned in thermal communication with the fresh food compartment.

5. A system in accordance with claim 4 wherein said tank comprises a plurality of legs.

6. A system in accordance with claim 5 wherein the refrigerator includes a fresh food compartment having a floor, said tank configured for releasable attachment to the floor of the fresh food compartment.

7. A system in accordance with claim 6 wherein said tank further comprises at least one bar comprising at least one opening and a fastener configured to pass through said opening to attach said tank to the floor.

8. A system in accordance with claim 1 further comprising a perforated central tube disposed within said outlet leg, said filter media surrounding said central tube.

9. A system in accordance with claim 8 wherein said filter media is cylindrical, said filter media further comprising a central opening therethrough, said opening receiving said central tube.

10. A water dispensing system for a refrigerator, said system comprising a water storage tank comprising at least an inlet portion for storage of unfiltered water and an outlet portion comprising a filter media for filtering said unfiltered water before use.

11. A water dispensing system in accordance with claim 10 further comprising a central tube situated within said outlet leg, said filter media surrounding said outlet tube.

12. A water dispensing system in accordance with claim 11, said central tube comprising an upstream end and a downstream end, an annular base extending from said upstream end and an outlet extending from said downstream end.

13. A water dispensing system in accordance with claim 10, said tank comprising a serpentine shape comprising at least one center leg extending between said inlet portion and said outlet portion.

14. A refrigerator comprising:

a fresh food compartment; and a water dispensing system in thermal communication with said fresh food compartment, said system comprising:

a water storage tank comprising at least an inlet portion for storage of unfiltered water and an outlet portion for discharging filtered water;

a perforated tube disposed within said outlet portion and comprising an upstream end and a downstream end, a base extending from said upstream end and an end cap coupled to said downstream end; and a filter media disposed about said tube between said end cap and said base.

15. A method of supplying chilled filtered water from a water dispensing system including an integral water tank and filter assembly having an inlet line and an outlet line, said method comprising the steps of:

introducing warm water into the tank through the inlet line;

passing the introduced water through the tank to chill the water;

filtering the chilled water while the water is within the tank.; and discharging the chilled water to the outlet line.

16. A method in accordance with claim 15 wherein said passing the water through the tank comprises the step of passing the water through a serpentine path.

17. A method in accordance with claim 15 wherein the refrigerator includes a fresh food compartment having a floor, said method further comprising fastening the tank in a horizontal position to the floor.

18. A method in accordance with claim 17 further comprising the step of unfastening the tank and filter from the floor and replacing the tank.

19. A method of supplying chilled filtered water with a refrigerator dispensing system, the refrigerator including a fresh food compartment and the dispensing system including an integral water tank and filter assembly, the tank having an inlet, an outlet, and a flow path therebetween, said method comprising the steps of:

fastening the tank in a substantially horizontal position in thermal communication with the fresh food compartment;

connecting the tank inlet to a water supply inlet line such that relatively warm water is introduced into the tank through the inlet line;

connecting the tank outlet to a dispenser system outlet line;

passing the introduced water through the flow path to chill the introduced water;

filtering the chilled water while the water is within the tank just prior to use; and discharging the chilled water to the outlet line.

20. A method in accordance with claim 19 further comprising passing the cooled filtered water through a perforated tube prior to said discharge.

21. A method in accordance with claim 19 wherein the tank includes a filter media, said filtering the water comprises passing the water radially inwardly through the filter media within the tank.

22. A method of supplying chilled filtered water with a refrigerator dispensing system, the refrigerator including a fresh food compartment and the dispensing system including an integral water tank and filter media disposed about a tube within the tank, the tube having a downstream end, the tank having an inlet and a serpentine flow path therebetween, said method comprising the steps of:

removably fastening the tank in a substantially horizontal position in thermal communication with the fresh food compartment;

connecting the tank inlet to a water supply inlet line such that relatively warm water is introduced into the tank through the inlet line;

connecting the downstream end of the tube to a dispenser system outlet line;

passing the introduced water through the flow path to chill the introduced water;

passing the introduced water radially through the filter media and into the central tube just before use; and discharging the chilled water from the tube downstream end to the dispenser system outlet line.

23. A replacement kit for a water storage tank and water filter of a chilled water supply system for a refrigerator including a fresh food compartment floor, said replacement kit comprising:

an integral serpentine water storage tank and water filter media, said water filter media within an outlet leg of said tank; and a quick release fastener configured to rapidly attach said tank to the fresh food compartment floor.

24. A replacement kit in accordance with claim 23 wherein said water filter media is permanently disposed within said outlet leg of said tank.

* * * * *